US006298014B1

(12) United States Patent
Kihara et al.

(10) Patent No.: US 6,298,014 B1
(45) Date of Patent: Oct. 2, 2001

(54) TIME INFORMATION MANAGEMENT SYSTEM

(75) Inventors: Hiroyuki Kihara; Toshio Umemoto; Tomomi Murakami; Masahiro Sase, all of Tokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/214,736

(22) Filed: Jan. 11, 1999

(30) Foreign Application Priority Data

May 12, 1998 (JP) ..... 9-122137

(51) Int. Cl.[7] ..... G04C 13/00; G04C 11/02; G04C 13/04

(52) U.S. Cl. ..... 368/46; 368/47; 368/55

(58) Field of Search ..... 368/10, 46, 47, 368/49, 52, 55, 185, 187

(56) References Cited

U.S. PATENT DOCUMENTS

| | | | | |
|---|---|---|---|---|
| 5,251,191 | * | 10/1993 | Sturz et al. | 368/47 |
| 5,363,377 | * | 11/1994 | Sharpe | 570/100.1 |
| 5,375,104 | * | 12/1994 | Ishii et al. | 368/20 |
| 5,677,895 | * | 10/1997 | Mankovitz | 368/10 |
| 5,805,530 | | 9/1998 | Youngberg . | |
| 5,859,595 | * | 1/1999 | Yost | 340/829.44 |

FOREIGN PATENT DOCUMENTS

| | | | |
|---|---|---|---|
| 53-26500 | | 8/1978 | (JP) . |
| 61-102580 | | 5/1986 | (JP) . |
| 62-276488 | | 12/1987 | (JP) . |
| 63-19587 | | 1/1988 | (JP) . |
| 64-25091 | | 1/1989 | (JP) . |
| 2-77681 | | 3/1990 | (JP) . |
| 6-78064 | * | 3/1994 | (JP) . |
| 6-222168 | | 8/1994 | (JP) . |
| 7-159556 | * | 6/1995 | (JP) . |
| 7-336453 | * | 12/1995 | (JP) . |
| 9-113647 | | 5/1997 | (JP) . |
| 9-36900 | * | 7/1997 | (JP) . |

* cited by examiner

*Primary Examiner*—Vit Miska
(74) *Attorney, Agent, or Firm*—Scully, Scott, Murphy & Presser

(57) ABSTRACT

A time information management system with a simple configuration that instantaneously causes the individual time information of a plurality of timekeeping means within a prescribed area to coincide with standard time information, is formed by time information signal generating means that generates time information that includes standard time information, a time information adjusting means that includes within it a first timekeeping means, receives a time information signal, and outputs time information of the timekeeping means, and second timekeeping means 5-1, 5-2, . . . , 5-n that are disposed in an area surrounding the time information adjusting means 3, the time information adjusting means 3 including a standard time information extraction means for extracting standard time information from the time information signal of the time information signal generating means 2, a standard time correcting means 7 that corrects the first timekeeping means 4 within the time information adjusting means 3 to the standard time information, and a time information output means 8 that causes output of the standard time from the first timekeeping means 4, the standard time being received by the second timekeeping means and the kept time stored in the second timekeeping means being corrected based on the standard time.

8 Claims, 1 Drawing Sheet

TIME INFORMATION MANAGEMENT SYSTEM

BACKGROUND OF THE INVENTION

1. Field of the Invention

The present invention relates to a time information management system, and more particularly to a time information management system that uses public standard time information and which causes the timekeeping condition of one or more clock means existing within a pre-established area to always coincide with this public standard time information.

2. Background of the Invention

In the past, in a system for example such as a master-slave clock system, one known method of aligning the time information of clocks within one system to the same time information, such as noted in Japanese Unexamined Patent Publication (KOKAI) No. 62-276488, is that in which a plurality of transmission lines are used to connect the master clock to a plurality of slave clocks and in which, in the time-setting mode, the master clock sends to the slave clocks time information for use after the time setting, using digital time-division multiplexing transmission, so that transmission is made to each of the slave clocks in sequential fashion, thereby setting the time information of clocks in one system to one and the same time information.

Recently, other known methods include a method of making a connection to a time displaying means that has a telephone control apparatus by using a telephone line, and using standard time information, such as JJY time information, that is sent via this telephone line to correct the time information of the time displaying means, a method of receiving either time information that is included in radio information that is transmitted from a man-made satellite or receiving standard time information that is included in ground-based television or radio broadcasts to either automatically or manually correct the time information that is currently being displayed by a prescribed timekeeping display means.

However, in these methods of the past, such as with the time information correction method that is noted in Japanese Unexamined Patent Publication (KOKAI) No. 62-276488, because the time information that is kept by the master clock is the reference time information, in the case in which there is an error in the time information kept by the master clock with respect to standard time information, all the slave clocks connected thereto will have an error with respect to the standard time information, the result being that it was necessary to use some means to accurately correct the time information of the master clock.

In the latter described methods of time information correction, using the above-noted public standard time information it is possible in a single operation to correct the time of only one clock, so that in the case in which there is a plurality of clocks or timekeeping means, it is necessary to execute the above-noted correction operation separately and repeatedly.

For this reason, with respect to a plurality of clocks or timekeeping means, the operation of correcting the currently displayed time information to coincide with the standard time information became complex and time consuming.

An object of the present invention is to provide a time information correction system which improves on the drawbacks of the prior art as noted above and, while having a simple configuration, causes the individual time information of one or more clocks existing within a prescribed area, or of a timekeeping means that forms an appropriate timer means to instantaneously coincide with the current standard time information.

DISCLOSURE OF THE INVENTION

To achieve the above-noted object, the present invention adopts the following basic constitution.

Specifically, this is a time information management system that is formed by a time information management system that comprises a time information signal generating means that generates time information that includes standard time information, a time information adjusting means that is provided independently from the time information signal generating means, including within it a first timekeeping means, which receives a time information signal that includes standard time information and also outputs time information of the timekeeping means, one or a plurality of second timekeeping means provided independently from the time information adjusting means and disposed in a fixed or movable manner in an area surrounding the time information adjusting means, the time information adjusting means including a standard time information extracting means that extracts standard time information from a time information signal that is received from the time information signal generating means, a standard time information correction means that corrects the current time of the first timekeeping means that is included within the time information adjusting means to the correct standard time information utilizing the standard time information extracted from the standard time information extracting means, and a time information that outputs the standard time information from the first timekeeping means that is set to the correct standard time information, the configuration being such that the second timekeeping means receives the standard time information that is output form the time information output means and the timekeeping information within the second timekeeping means is corrected based on the standard time information.

By using the above-noted technical constitution, a time information management system according to the present invention can receive standard time information that is periodically output via a prescribed medium by a prescribed public organization in various countries in the world and, based on this standard time information, can easily and quickly adjust the time information of all appropriate timekeeping means provided in a fixed manner within a prescribed region, or appropriate timekeeping means provided in a movable manner within this prescribed region to the standard time information at that point in time.

DESCRIPTION OF THE PREFERRED EMBODIMENTS

The configuration of an example of a time information management system according to the present invention is described in detail below, with reference being made to the drawings.

Figure 1:
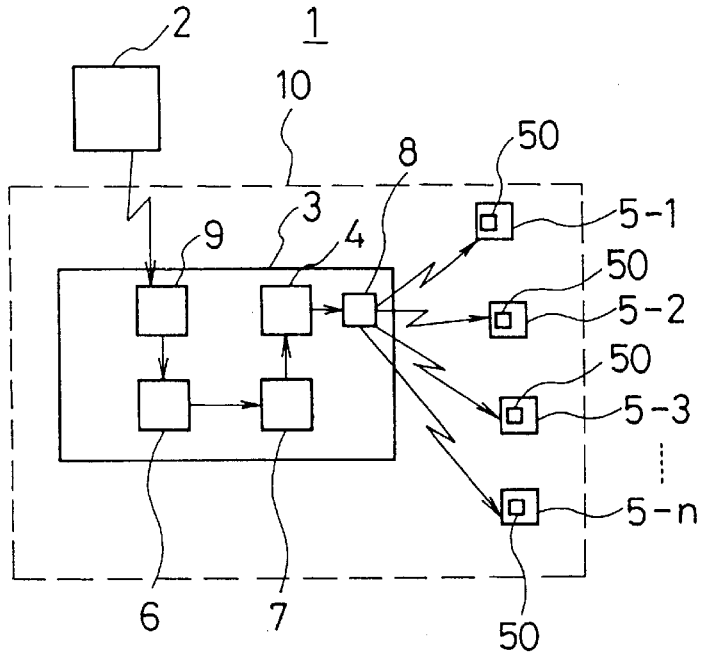
FIG. 1 is a block diagram that shows the configuration of an example of a time information management system according to the present invention.

FIG. 1 is a drawing that shows the configuration of an example of a time information management system according to the present invention.

This drawing shows a time information management system 1 that is formed by a time information signal generating means 2 that generates time information that includes standard time information, a time information adjusting means 3 that is provided independently of the above-noted time information signal generating means 2, including a first timekeeping means 4, which receives a time information signal that includes standard time information and also outputs the time information of the above-noted timekeeping means, and one or a plurality of timekeeping means 5-1, 5-2, . . . , 5-n independent of the above-noted time information adjusting means 3 and disposed in an area surrounding the time information adjusting means either in a fixed manner or a movable manner, the time information adjusting means 3 including a standard time information extracting means 6 that extracts standard time information from the time information signal received from the time information signal generating means 2, a standard time correcting means 7 that corrects, using the standard time information extracted from the standard time information extracting means, the current time of the first timekeeping means 4 that is included within the time information adjusting means 3 to the correct standard time information, and a time information output means 8 that causes output of this standard time information from the first timekeeping means 4 that is set to this correct standard time information, the configuration being such that the second timekeeping means 5-1, 5-2, . . . , 5-n receives the standard time information that is output form the time information output means 8 and the timekeeping information within the second timekeeping means 5-1, 5-2, . . . , 5-n is corrected based on the standard time information.

That is, because the time information management system 1 according to the present invention enables simultaneous or successive setting, by means of a simple operation, of timekeeping means provided in a fixed manner within a prescribed area 10 or one or a plurality of timekeeping means 5-1, 5-2, . . . , 5-n provided within the prescribed area 10 in a movable manner to accurate standard time information, it is capable of maintaining any second timekeeping means 5-1, 5-2, . . . , 5-n which have an error with respect to the standard time information, at the accurate time information.

It is desirable that a time information management system 1 according to the present invention have, in at least the second timekeeping means of the first timekeeping means 4 and second timekeeping means 5-1, 5-2, . . . , 5-n, a timekeeping function and an appropriate display function that displays the time information that is kept.

There is no particular restriction with regard to the time information signal generating means 2 in the present invention, and it is possible to use any construction that has a function that generates extremely accurate standard time information, such as output by a public organization for use in either the associated country or other specified region.

In Japan, for example, it is possible to use such sources as JJY, telephone JJY, GPS, the standard time information (for example, NHK and the Ministry of Posts and Telecommunications Central Laboratory) carried by radio wave such as shortwave, longwave, or standard time information carried by FM and AM, or the telephone time signal obtained by dialing 117.

In addition to the above-noted radio signals, it is possible to use a time information signal generating means 2 that outputs via a wireless information transmission means using light, sound, vibration, pressure, or magnetism, for example, and also possible to use a time information signal generating means 2 that performs output via a wire-type transmission means configured to perform output using wire, A.C. commercial power mains, or wiring within a general dwelling.

In the present invention, one or a plurality of the above-noted time information signal generating means 2 are used to correct the current time of a prescribed timekeeping means.

Further in the present invention, the time information adjusting means 3 provided in the predetermined area in which one or a plurality of the timekeeping means 5-1, 5-2, . . . , 5-n being provided has an receiving circuit 9 for receiving the standard time information output from the time information signal generating means 2 and the receiving circuit 9 also has a carrying means to carry the standard time information generated by the time information signal generating means 2, i.e., a function whereby a suitable medium corresponding to any kinds of standard time information carrying medium, can be received.

In the present invention, it is desirable that the time information adjusting means 3 be configured so as to receive standard time information via at least one carrier means that is selected from a wireless information transmission means via radio waves, light, wire, sound, vibration, or a magnetic field or the like and a wire-type information transmission means via A. C. commercial power mains or wiring within a general dwelling or the like.

In the present invention, by means of the above-noted method, information that includes standard time information and that is received from the time information signal generating means 2 via a receiving circuit 9, has the standard time information and the standard time information is only extracted from the information at the standard time information extracting means 6, this extracted standard time information being used by the standard time correcting means 7 to correct the current time of the first timekeeping means 4 that is provided within the time information adjusting means 3 to the correct standard time information.

From the first timekeeping means 4 that is set to the correct standard time by the standard time correcting means 7, this standard time information is output via the time information output means 8 and transmitted to the second timekeeping means 5-1, 5-2, . . . , 5-n, enabling either simultaneous or successive correction of each of the current time information of these second timekeeping means 5-1, 5-2, . . . , 5-n.

There is no particular restriction with regard to the time information adjusting means 3 that has within it the above-noted first timekeeping means 4 in the time information management system 1 according to the present invention, and it is possible, for example, to use an electrical apparatus such as a personal computer (PC), a telephone, a clock, a radio, or a television, and it is also possible to appropriately make a selection of one or a plurality of such electrical apparatuses.

The second timekeeping means 5-1, 5-2, . . . , 5-n used in the present invention, have a time information correction function 50 that corrects the time information that is stored in each of the second timekeeping means 5-1, 5-2, . . . , 5-n, based on the standard time information that is output from the first timekeeping means 4.

It is desirable that the second timekeeping means 5-1, 5-2, . . . , 5-n in the present invention be one or a plurality of such apparatuses as a timer means that is included in a personal computer, a word processor, a telephone, a television, a watch (including a table clock, a wristwatch, a wall clock, and a vehicular clock), an air conditioner, a washing machine, a water heater, a bath boiler, various cooking appliances, gas equipment, or other consumer appliance, this having a timekeeping information display means and also a time information self-correction function 50 built thereinto.

In the present invention, one or a plurality of the above-noted second timekeeping means 5-1, 5-2, . . . , 5-n is disposed in a fixed manner or a movable manner within a prescribed area.

For example, such an above-noted prescribed area includes such areas as the area within one household or within a prescribed room, school, library, gymnasium, or other public facility, or points in a public transportation facility such as a railway, within which a plurality of second timekeeping means 5-1, 5-2, . . . , 5-n are disposed at arbitrary positions, each one of the second timekeeping means 5-1, 5-2, . . . , 5-n receiving either periodically or as required accurate standard time information from the time information adjusting means 3 within the first timekeeping means 4 disposed within the prescribed area, accurate standard time information being displayed, via the time information correction function 50 within each of the second timekeeping means 5-1, 5-2, . . . , 5-n.

The transmission of standard time information between the time information adjusting means 3 and the second timekeeping means 5-1, 5-2, . . . , 5-n is performed by at least one general transmission means that is selected from a wireless information transmission means via radio waves, light, wire, sound, vibration, pressure or a magnetic field or the like and a wire-type information transmission means via A.C. commercial power mains or wiring within a general dwelling or the like.

By way of a more detailed description of the time information management system 1 according to the present invention, in the case, for example, in which the current times of a plurality of second timekeeping means within a household of a certain size are all to be corrected to accurate standard time information, a personal computer, telephone, or word processor disposed at a prescribed position within the household is used as the time information adjusting means 2, this time information adjusting means 2 being connected to a telephone line and configured so as to receive telephone JJY standard time information.

The received standard time information being output via the time information output means 8, so that transmission is made by radio waves so that sufficient transmission is achieved within the household.

Within the household, a timekeeping means that serves also a time display means and timer means provided in a television, a radio, a rice cooker, a clock, a telephone, or air conditioner or the like, these being the second timekeeping means 5-1, 5-2, . . . , 5-n of the present invention, is provided with a receiving function for receiving standard time information carried by radio wave and the time information correction function 50 that causes the time information of each of the timekeeping means to coincide with this standard time information based upon the standard time information and, at a prescribed timing, for example a frequency of one time or two times every hour, the time information adjusting means 2 receives information with regard to standard time information from the time information signal generating means 2, this information being output from the time information output means 8 by means of radio waves, making it easy to cause the time information of all the second timekeeping means 5-1, 5-2, . . . , 5-n having a time information correction function 50, such as in a television, a radio, a rice cooker, a clock, a telephone, or an air conditioner, to comply with the standard time information.

In this example, in the case in which a time information correction function 50 that corrects the time information of the timekeeping means provided within a wristwatch upon a reception of the standard time information by radio wave, is provided in a wristwatch, it is possible for the person wearing the wristwatch to merely pass by the front of a personal computer, which is one example of above-noted time information adjusting means 3, to easily execute a time correction of the wristwatch.

In a case of the transmission of standard time information between the time information adjusting means 3 and the second timekeeping means 5-1, 5-2, . . . , 5-n of the present invention, in the case of utilizing either the A.C. commercial power mains or wiring within a general dwelling, because a transmission is executed by superimposing the standard time information onto the A.C. commercial power mains or wiring within a general dwelling, it is possible to easily perform correction of the current time in a timer means and timekeeping display means in all electrical apparatuses configured so as to obtain power from an outlet within the dwelling.

In another example of the present invention, in which a vehicular radio is used, this radio being provided with a receiving function that receives the standard time information described above, a function that corrects the time information of its own first timekeeping means, and a transmitting function, and by doing so it is possible to cause the time information of various timekeeping means, including a clock within the vehicle, to accurately coincide with the standard time information.

In the present invention, in the case in which, for example, the time information signal generating means 2 transmits standard time information by radio, it is possible in the time information adjusting means 3 to send this standard time information in the same manner by radio to the second timekeeping means, for example, and also possible to send this to the second timekeeping means 5-1, 5-2, . . . , 5-n, by converting it to a different medium, such as light, sound, vibration, or pressure.

In some cases, the time information adjusting means 3 can be configured so as to perform transmission thereof using one or a plurality of selected media that is the same as or different from the carrier medium using to carry the standard time information.

Additionally, it is desirable that the time information adjusting means 3 include a format converting means that converts the format of the standard time information that is output from the time information signal generating means 2 to at least one standard time information format that is suitable for the second timekeeping means 5-1, 5-2, . . . , 5-n.

A more detailed example of a time information management system 1 according to the present invention will be described, with reference being made to FIG. 2.

Figure 2:
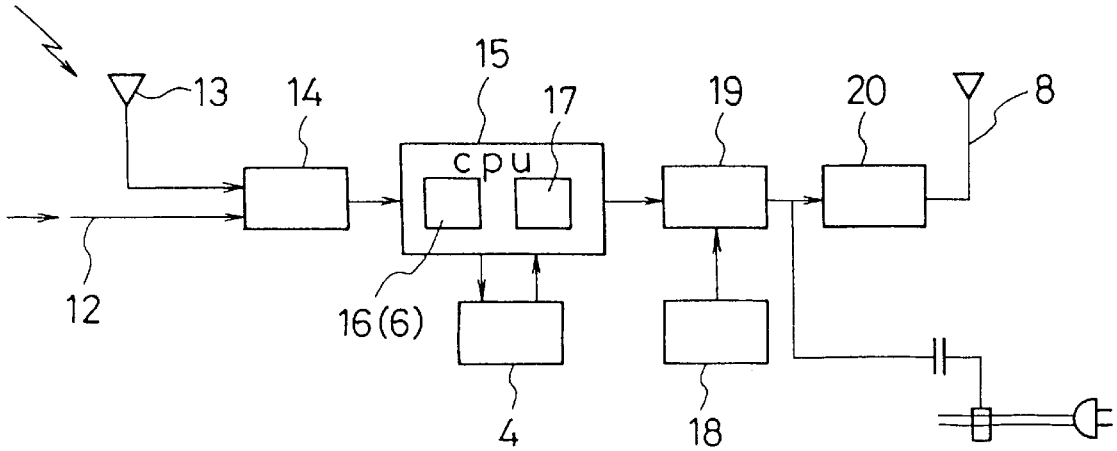
FIG. 2 is a block diagram that shows the configuration of an example of a time information adjusting means that is used in a time information management system according to the present invention.

FIG. 2 is a block diagram that shows the internal configuration of the time information adjusting means 3 of an example of the present invention, in which when standard time information that is output from an appropriate time information signal generating means 2 is received by an antenna 13 or wire 12 that forms the receiving circuit 9 it is transmitted to a modem 14.

Then, the output of the modem 14 is input to an appropriate processing circuit (CPU) 15, standard time information is extracted from the received signal using the extraction circuit 16 and, based on the extracted standard time information, the time of the first timekeeping means 4 within the time information adjusting means 3 is corrected via an appropriate standard time correcting means (not shown in the drawing) corresponding to the standard time correcting means 7 as shown in FIG. 1, thereby causing the time of the first timekeeping means 4 to accurately coincide with the standard time information.

Then, in the present invention, in the case of correcting the time information of the noted second timekeeping means 5-1, 5-2, . . . , 5-n, the current time information of the first timekeeping means 4 is read out by the processing circuit (CPU) 15 and, based on the results, an operation is performed to convert the format of the standard time information to a format that is suitable for each of the second timekeeping means 5-1, 5-2, . . . , 5-n that is used.

That is, an appropriate format converting function 17 is provided in the processing circuit (CPU 15) as required.

In the present invention, execution is possible without using this format converting means 17.

Next, in the present invention, at a modulation means 19 that is connected to an appropriate oscillation means 18 the standard time information that is output from this format converting means 17 is appropriately modulated and, via an appropriate amplification means 20, standard time information adjustment is executed with respect to each of the second timekeeping means 5-1, 5-2, . . . , 5-n.

In addition to using radio waves, the standard time information adjustment with respect to each of the second timekeeping means 5-1, 5-2, . . . , 5-n can be performed by using a wireless information transmission method as well as by the transfer method which transmits the standard time information by using a change in light, sound, pressure, or a magnetic field, for example, or by a wire-type information transmission method such as by wire, A.C. commercial power mains, or wiring within a general dwelling.

In the present invention, as described above, the transmission of standard time information from the time information adjusting means 3 to each of the second timekeeping means 5-1, 5-2, . . . , 5-n need not be performed by a single medium, and can be performed by the combined use of mutually different output information transmission.

Yet another example of the present invention is described below.

Specifically, a standard radio signal that is currently sent out by longwave (40 kHz) domestically in Japan contains a time code.

There are wristwatches, table watches and the like being sold that receive this radio signal and perform accurate time setting.

In this system of time correction, however, at a distance from the transmission location the radio waves become weak, and there are many cases in which indoor reception is impossible, this presenting an inconvenience.

Because of this situation, in the present invention the modem 14 shown in FIG. 2 is used to receive telephone JJY information by wire.

That is, the extraction circuit 16 of the CPU 15 in FIG. 2 extracts the time information and the first timekeeping means 4 is accurately set to the current correct standard time.

This operation is executed periodically to achieve accurate time in the first timekeeping means 4.

Then, at the format converting means 17, conversion is made to the longwave standard radio signal time code format.

The received 40 kHz radio signal is modulated by the modulation means 19, and is transmitted by the time information output means (antenna) 8, via the amplification means 20.

It is desirable that the transmission timing be synchronized to the basic standard longwave radio signal. Because the time code transmission rate of this standard longwave radio signal is slow (1 bit/second), it is relatively easy to achieve synchronization without sacrificing the time correction function.

By installing this system indoors, it is possible to create an environment even indoors which is equivalent outdoors for receiving a standard longwave radio signal.

By means of this example, time setting can be performed in a wristwatch by the usual standard longwave radio signal when outside and by receiving a radio signal from this system when indoors.

In addition, in a wall clock or table clock, even within a room in which pickup of a standard longwave radio signal is difficult, it is possible to install the clock without considering the location, and also possible to perform accurate time setting at any time.

Because it adopts the technical constitution described above, a time information management system according to the present invention, in spite of its simple configuration, provides a time information correction system that instantaneously causes the time information of one or a plurality of clocks or timekeeping means that form timers within a prescribed area to current standard time information.

What is claimed is:

1. A time information management system comprising a time information signal generating means that generates time information that includes standard time information, a time information adjusting means that is provided independently from said time information signal generating means, including within it a first timekeeping means which receives a time information signal that includes standard time information and also outputs time information of the timekeeping means, at least one second timekeeping means provided independently from said time information adjusting means and disposed in a fixed or movable manner in an area surrounding said time information adjusting means, said time information adjusting means including a standard time information extracting means that extracts standard time information from a time information signal that is received from said time information signal generating means, a standard time information correction means that corrects the current time of said first timekeeping means that is included within the time information adjusting means to the correct standard time information utilizing said standard time information extracted from said standard time information extracting means, and a time information that outputs said standard time information from said first timekeeping means that is set to said correct standard time information, wherein said second timekeeping means receives the standard time information that is output from said time information output means, and said timekeeping information within said second timekeeping means is corrected based on said standard time information, and said time information adjusting means receives said standard time information that is output from said time information signal generating means by at least one of a selected wireless information transmission means and a wire-type information transmission means, and wherein said second timekeeping means comprises a timekeeping function and a function that displays the kept time information, and wherein said time information adjusting means includes a medium converting means that selects at least one carrier means for carrying the standard time information that is output from said time information signal generating means, and wherein said medium converting means selects a medium that is either the same as the carrier means for carrying the standard time information or different therefrom.

2. A time information management system according to claim 1, wherein said time information signal generating means is a means that selects at least one of GPS, the standard time information carried by radiowave such as shortwave, longwave, or standard time information carried by FM and AM radiowave, or telephone time information.

3. A time information management system according to either claim 1 or claim 2, wherein said time information adjusting means that includes within it said first timekeeping means is one that is selected from a personal computer (PC), a telephone, a clock, a radio, and a television.

4. A time information management system according to either claim 1 or claim 2, wherein said second timekeeping means includes a time information correction function that corrects the time information stored in said second timekeeping means, based on standard time information that is output from said first timekeeping means.

5. A time information management system according to claim 4, wherein said second timekeeping means is at least one timer means provided in an apparatus selected from a group of a personal computer, a word processor, a telephone, a television, a radio, a clock (table clock, wristwatch, wall clock, vehicular clock), an air conditioner, a washing machine, or a bath boiler, various cooking appliance, gas equipment, or other consumer appliance.

6. A time information management system according to either claim 1 or claim 2, wherein transmission of standard time information between said time information adjusting means and said second timekeeping means is executed via at least one carrier means selected from a wireless information transmission means such as radiowaves, light, sound, vibration, pressure, magnetic field, and wire-type information transmission means such as A.C. commercial power mains and wiring within a general dwelling.

7. A time information management system according to claim 1, wherein said medium converting means selects a plurality of media that are either the same as the carrier means for carrying the standard time information or different therefrom.

8. A time information management system according to either claim 1 or claim 2, wherein said time information adjusting means comprises a format converting means that performs conversion of the format of standard time information that is output from said time information signal generating means to at least one format that is suitable for said second timekeeping means.

* * * * *

UNITED STATES PATENT AND TRADEMARK OFFICE

CERTIFICATE OF CORRECTION

PATENT NO. : 6,298,014 B1
DATED : October 2, 2001
INVENTOR(S) : Hiroyuji Kihara

It is certified that error appears in the above-identified patent and that said Letters Patent is hereby corrected as shown below:

Title page,

Item [30], Foreign Application Priority Data, "May 12, 1998" should read -- May 13, 1997 --

Item [22], delete "Filed: Jan 11. 1999" and insert -- PCT Filed: May 12, 1998 --

After Item [22], insert the following:

| | | |
|---|---|---|
| -- [86] | PCT No.: | **PCT/JP98/02096** |
| | § 371 Date: | **January 11, 1999** |
| | § 102(e) Date: | **January 11, 1999** |
| [87] | PCT Pub. No: | **WO98/52107** |
| | PCT Pub. Date: | **November 19, 1998** -- |

Signed and Sealed this

Tenth Day of August, 2004

JON W. DUDAS

*Acting Director of the United States Patent and Trademark Office*